United States Patent [19]

Lakeman

[11] 3,989,250

[45] Nov. 2, 1976

[54] GAME APPARATUS

[76] Inventor: Thomas Ashley Lakeman, High Branches, Collington Rise, Bexhill, Sussex, England

[22] Filed: June 17, 1975

[21] Appl. No.: 587,727

[52] U.S. Cl. ..... 273/102 S; 273/105 R; 273/DIG. 26; 272/1 B; 273/104

[51] Int. Cl.[2] ..... A63B 71/02

[58] Field of Search ..... 273/136 C, 123 R, 124 R, 273/125 R, 127 R, 102 R, 105 R, 102.4, DIG. 26; 272/1 B; 47/35

[56] References Cited

UNITED STATES PATENTS

| | | | |
|---|---|---|---|
| 599,996 | 3/1898 | Engle | 47/35 |
| 3,117,787 | 1/1964 | Stutzke | 273/105 R |
| 3,134,594 | 5/1964 | Crowley | 273/105 R |
| 3,430,958 | 3/1969 | Lakeman | 273/105 R |
| 3,778,060 | 12/1973 | Lakeman | 272/1 B |
| 3,822,063 | 7/1974 | Rea | 273/105 R |
| 3,895,801 | 7/1975 | Baird | 272/1 B |

*Primary Examiner*—Richard C. Pinkham
*Assistant Examiner*—Marvin Siskind
*Attorney, Agent, or Firm*—Schuyler, Birch, Swindler, McKie & Beckett

[57] ABSTRACT

A game apparatus suitable for playing with balls which includes a first base member having two opposed holes within which are releasably secured an inverted U-shaped member which extends over a central opening in the first base member, which opening collects balls in the game, the first base member having a plurality of further holes spaced around its periphery with a plurality of pegs located in the peripheral holes.

10 Claims, 7 Drawing Figures

GAME APPARATUS

FIELD OF THE INVENTION

This invention relates to apparatus for use in playing water or land games incorporating the use of balls, quoits, skittles, batons and the like. In particular the apparatus of this invention is designed to allow the playing of water or land games for a large or small number of people in a restricted area.

SUMMARY OF THE INVENTION

According to the present invention there is provided a game apparatus comprising an inverted U-shaped member releasably secured to a first base number within two opposed holes in the first base member, a central opening in the first base member over which the U-shaped member extends and a plurality of further holes spaced around the periphery of the first base member.

More particularly the game apparatus of the present invention preferably also includes a secondary base member in the form of a collection surface over the base member having a plurality of collection holes formed therein and a central scoring indicator dial formed in the middle of the collection surface.

The apparatus is particularly constructed for use in water and on land and especially in swimming pools which often provide a rather limited or restricted space. Games using the apparatus preferably use a plurality of playing members and can be played by one or a number of players using one or more apparatus.

When used in water the first base member of the apparatus is preferably of substantially round shape made out of a suitable buoyant material. The base member is preferably anchored in position using one or a pair weighted cords preferably made of nylon which are attached to the bottom of the base member or it may be anchored by a rope stretched across the pool.

The invention also includes the provision of a number of interchangeable secondary base members which are adapted to fit over the first base member in order that a variety of games may be played with the same basic apparatus.

BRIEF DESCRIPTION OF THE DRAWINGS

In order that the invention may be more clearly understood and readily carried into effect the invention will now be described by way of example with reference to the accompanying drawings in which.

DESCRIPTION OF THE PREFERRED EMBODIMENTS

Figure 1:
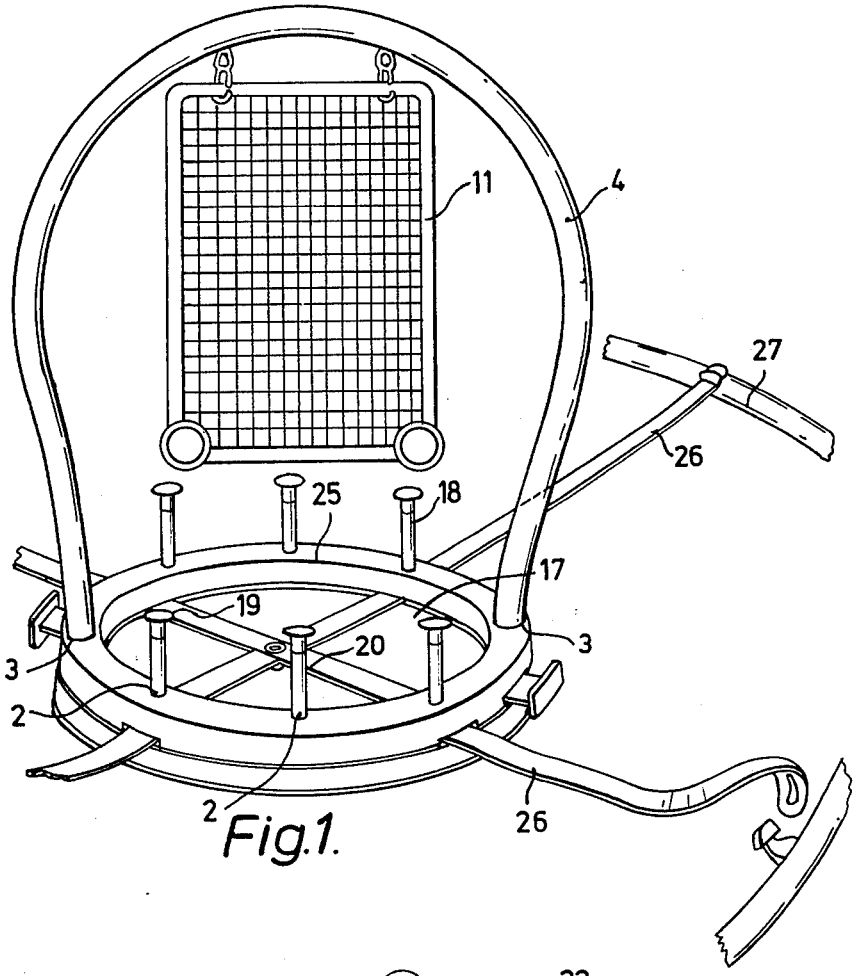
FIG. 1 is a perspective view of a preferred embodiment of the invention.

In the drawings a first base member indicated 25 of substantially round shape is constructed with six holes 2 disposed around the periphery of the base member, three in each half of the base member. Two further holes 3 are provided to releasably receive an inverted U-shaped member 4 as shown.

The first base member 25 is formed with a large central aperture 17 and preferably has a number of upstanding pegs 18 releasably located in peripheral holes 2. The pegs 18 have mushroom-shaped tops 19 with elongated stems 20 so that they may conveniently receive quoits in a quoit game.

Suspended from the inverted U-shaped member 4 is a swingable member 11 which is used either as an indicating means or as a means of preventing for example quoits or balls from passing through the member 4.

When the game apparatus is to be used in water, the apparatus is assembled preferably in a form as shown in FIG. 1 the first base member 25 being stabilised by a buoyant surround 27 attached to the first base member 25 by radial plastics rays 26. The positioning of the first base member 25 when used in water is left substantially constant by a pair of weights (not shown) which are each attached to the first base member by a cord which anchors the apparatus to the bottom of a swimming pool or to the sea-bed or alternatively the base member may be anchored by a rope stretched across the pool.

Figure 2:
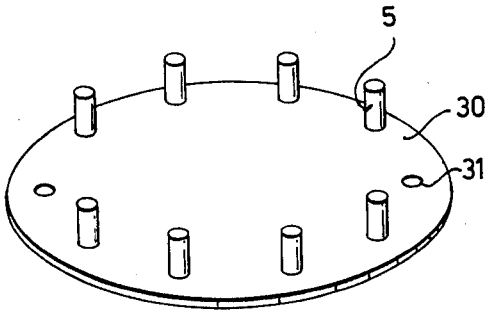
FIG. 2 is a perspective view of a secondary base member.

FIG. 2 shows a perspective view of a secondary base member 30 which is provided with protruding rods or tubes 5 but has holes 31 to receive the inverted U-shaped member 4 hereinafter simply referred to as the arch 4. This secondary base member 30 is of similar round shape to the first base member 25 and in use is located above the first base member 25 by passing the releasable arch 4 both through holes 31 and holes 3.

Figure 3:
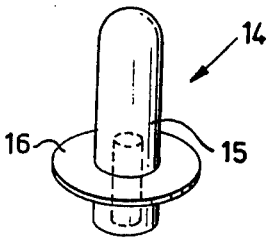
FIG. 3 is a baton or skittle.

A preferred baton or skittle 14 for use in conjunction with the secondary base member 30 is illustrated in FIG. 3 and is formed of a hollow tube 15 closed at one end with a flange 16 positioned around the tube and adjacent the open end. The baton 14 may be used in two ways e.g. the closed end may form an alternative to pegs 18 and may be sloted into the holes 2 of the first base member 25 or the open end may be placed over the protrusions 5 of the secondary base member 30.

Figure 4:
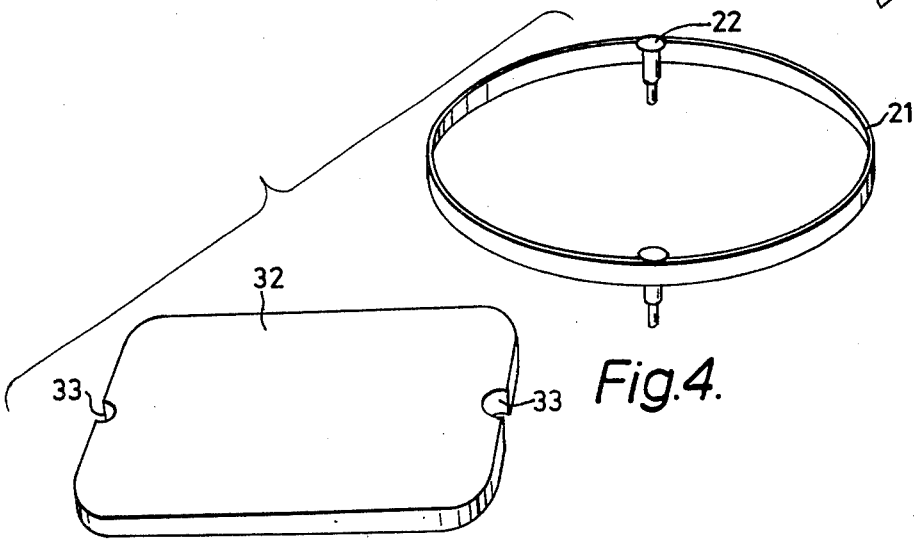
FIG. 4 shows an alternative secondary base member and a retaining ring.

In FIG. 4 a retaining ring 21 is shown with two pegs 22 formed as an integral part and this ring 21 may be fitted over the base member 25 so as to retain playing members that hit the swinging member 11 in the arch 4. Naturally the retaining ring 21 may only be used if pegs 18 are removed from the base member since pegs 22 are secured by using the same holes as pegs 18.

FIG. 4 also includes an alternative secondary base member 32 which may be used in conjunction with the first base member to form a solid base. The secondary base member 32 is substantially square in shape and is formed with two opposed semi-circular indentations 33 so that it may be conveniently seated over the first base member 25 and about the legs of the arch or removal of pegs 18 for use in a tennis type hand ball game.

Figure 5:
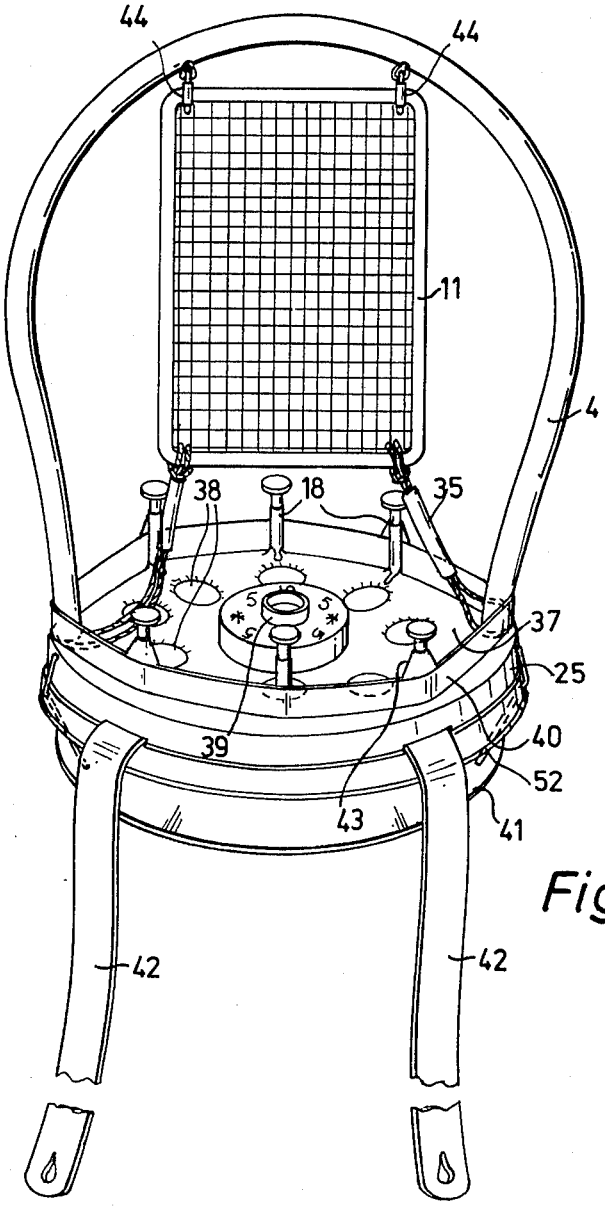
FIG. 5 shows a further alternative secondary base member

In the embodiment of FIG. 5 there is suspended from the arch 4 the target 11 which is secured to the top of arch 4 by split links 44 and loosely to the bottom of arch 4 by cords 35 which allow the target 11 some freedom of movement.

Disposed on the periphery of base member 25 are the six upstanding pegs 18 in holes 2 between which a secondary base member in the form of a flexible collection surface 37 is stretched.

Collection surface 37 is provided with eight collection holes 38 which are all slightly dished and which are each located in radial alignment with either a peg 18 or the arch 4. In the center of collection surface 37 is a rotatable scoring dial 39 which has scoring markings which in use are positioned in radial alignment with holes 38 by location of a depending lug 50 on the dial in a hole of an inner circle of holes 51 in radial alignment with holes 38. The center of dial 9 may be hollow so as to form a pocket for stake counters if so desired.

A clearly shown in FIG. 5 a removeable boundary band 40 extends around the outside of pegs 18 and is held in place by its self-resilience. The band 40 is preferably formed with four equally spaced projections 43 which, when a game is being used with balls only, enable the band 40 when turned upside down to be held just below the top of the pegs 18. Supports by an elastic card 52 is a stabilising and antirotational plate 41 disposed beneath base member 25 for use when the apparatus is in water. Extending downwardly away from the base member 25 are four (only two shown) radial rays 42 which are again mainly for use in water as they also tend to prevent unwanted rotation of the apparatus. In addition one or two keels or similar devices may be provided for the same purpose.

As an alternative to the embodiment described above the collection surface 37 may be made with a turned down rim (not shown) to fit over the outer rim of the base member 1.

The base members 25, 30, 32 and 37 are made of any suitable lightweight material e.g. polythene, and are usually about 12 to 24 inches in diameter. Batons 14 and pegs 18 are of about 4 inches in length and are of a suitable internal and external diameter so as to conveniently fit the protrusions 5 and holes 2 respectively.

If quoits are to be used they may be made of a suitable light-weight material e.g. soft rubber as in a sand quoit, and they may be used in conjunction with the apparatus when the pegs 18 are positioned in the peripheral holes 2. In a game using the apparatus of the present invention, the object is to place or throw a number, normally one to each player, of game members (e.g. balls, quoits, batons, pegs or the like) in or into a circular or rectangular container preferably after having raced by running or swimming to a predetermined point usually in the form of a relay race or in the case of balls and quoits thrown from a fixed base. As described above the batons may be plain cylindrical or tubular members or may have a flange to limit the travel to the baton when it is inserted into a hole or the travel of a baton may be limited by providing a stop in one or more of the holes 2 e.g. by providing a disc of suitable material under the first base member to close the lower end of the holes 2.

Figure 6:
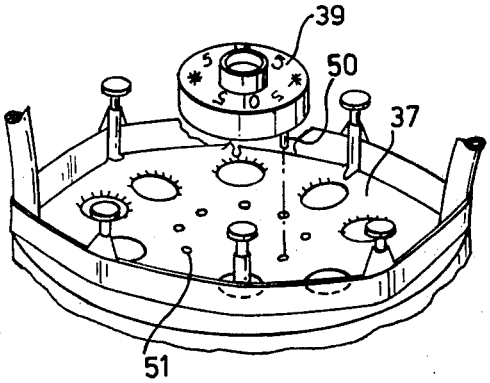
FIG. 6 is an exploded view of the secondary base member of FIG. 5.

To play a game using the embodiment of FIGS. 5 and 6 the scoring device 39 is set at a desired location and the players decide on the numerical value of two starred (unnumbered) positions on the device; 20 for each star may be used as standard scores and the number shown for other positions. Preferably the numbers of the scoring indicator are coloured and are split so that two fives, a 10 and a star are of one colour and two fives, a 10 and a star of another colour.

Players then each take four balls (or any other suitable number) and in turn throw the balls at the target from a suitable throwing base line e.g. a P.V.C. strip may be provided or in water a stretched rope. On hitting the target 11 the forward momentum of the ball is lost and it drops into one of the holes to be retained by the dish shape. Once one player has thrown all his balls only those which have fallen in his chosen colour area are recorded and then the next player takes his turn and so on. Players may compete from the same side of the apparatus or from each side.

When using quiots the boundary band 40, which is primarily for preventing balls from jumping out of the base member, may be removed and the game played by throwing the quoits so that they hook on the pegs 18 and then noting the score in relation to the scoring device. Alternatively quoits may be used together with balls and the boundary band 40 retained (as shown).

In order to make the playing members e.g. the balls or batons, more easily distinguishable for each team or player the balls or batons may be of different colours, each item or player having a separate colour.

With all the embodiment of FIGS. 5 and 6 described when balls are used, the balls may be numbered to act as a multiplier: for example a ball may be marked with a great circle line and the number 1 at one pole and any number between 2 and 10 at the other pole. When a ball is thrown and comes to rest in a collection hole 38 with the number 1 uppermost only the number on the dial scores. However, if the great circle line is vertical or the number 2 to 10 uppermost the dial score is multiplied by the number 2 to 10 on the ball.

Although games using the apparatus of the invention have been described particularly with reference to water games it may be equally as convenient to play the games on land. As an alternative to using the radial rays 7, and surrounds 27 the apparatus may be disposed on a "brink" board which would extend from the side of a swimming pool above the water. The brink board is of substantially rectangular shape with a semi-circular cut-out at its operative end. In use the brink board is preferably disposed with its operative end over the water and the other end weighted down or clamped in any suitable manner. The apparatus of the invention, is placed on the operative end of the brink board so that playing members entering the base member will fall through the aperture 17 and semi-circular cut-out and back into the water so that play may be continued.

All the base members disclosed are formed with holes 3, 31 or 33 to receive the legs of the arch and the arch, when inserted into these holes, is held in position by the stress present in the shape of the member. Therefore removal of the arch and consequently the interchanging of secondary base members is a relatively easy and short operation. The arch 4 may be additionally held in position by a stop cord and knot that keeps the arch firmly in position even after long use.

Other ways in which the invention may be used in ball games on land or water are for example:

i. to play a normal goal game similar to basketball or water polo, ii. to play a ball game backwards and forwards through the arch without a net (similar to returns in tennis) using the secondary base member of FIG. 4.

iii. to play a ball game using the first base member of FIG. 1 so that the base acts as a "bucket" collection point or a goal and iv. to play a relay game using either the first base member alone or the secondary base member of FIG. 2 with players dribbling or carrying either a ball or one of the batons or a quoit.

Figure 7:
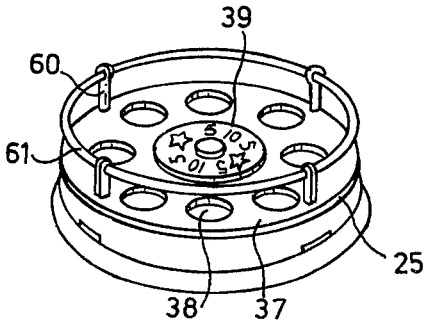
FIG. 7 is a perspective view of a further alternative arrangement.

When the invention is to be used for example against the side or end of a swimming pool semi-circular or half-square surrounds may be used for convenience instead of surround 27 to prevent players approaching too close to the goal. FIG. 7 illustrates a further alternative embodiment which is a variation of the embodiment of FIG. 5 and 6 and in which the arch 4 is not used.

This further embodiment is intended for use mainly with balls and comprises the first base member 25 over which is stretched a secondary base member in the form of collection surface 37. The secondary base member 37, as with the embodiment of FIGS. 5 and 6, has collection holes 38 and a central rotatable scoring indicator 39. The first base member 25 preferably has eight peripheral holes only four spaced holes of which are used in this embodiment. These four holes each receive one support peg 60 which supports a firm ring 61 at about 2 to 3 inches from the surface of the secondary base member 37.

As an addition to the apparatus shown in this figure the central stake pocket of the scoring indicator 39 may be adapted to receive a peg (not shown) of similar shape to the pegs 18 of FIG. 1 but having an enlarged stem. By using this arrangement quoits may be used with the embodiment. The scoring indicator 39 of this embodiment has numbers of two different colours namely blue and red so that two fives, a ten and a star are of one colour and the remainder of the other colour. When two players are to play two sets of balls are used:

i. two blue balls and one white;

ii. two red balls and one yellow.

The blue or red balls only score in their respective colour indicated collection holes 38 but the white and yellow balls are "jokers" and score in any hole. The dimensions of the collection holes 38 and the balls with which the game is played are so arranged that during a game the balls of one player may be "cannoned" or knocked out of their hole into another — this may have the effect of moving a blue ball from a blue numbered collection hole in which the ball scores to a red numbered collection hole in which it does not.

Also the firm ring 61 surrounding the base member is placed at such a height relative to the size of ball used that in use a ball may be thrown onto the ring 61 so that it curves around the ring to become lodged in a hole on the near side of the apparatus. As will be understood from the above a good deal of skill is envolved in effecting the cannoning or "curving" of a ball.

If a game is to be played in a restricted area or on a deck of a boat where the ball could be lost the game is played by using a ball tethered to a stop (not shown). Once the tethered ball has been played it is removed from the collection hole and replaced by a standard ball.

What is claimed is:

1. A game apparatus suitable for playing with balls comprising a first base member having two opposed holes, an inverted U-shaped member releasably secured to the first base member within the two opposed holes, the first base member having a central opening therein for collecting balls in a game over which central opening the U-shaped member extends, said first base member having a plurality of further holes spaced around the periphery thereof and a plurality of pegs for location in said plurality of peripheral holes.

2. A game apparatus according to claim 1 further including a secondary base member adapted to fit over the first base member.

3. A game apparatus according to claim 2 wherein the secondary base member has a number of peripheral protrusions.

4. A game apparatus according to claim 2 wherein the secondary base member is a substantially square shaped board.

5. A game apparatus according to claim 2 wherein the secondary member is a collection surface over the first base member and has a plurality of collection holes formed therein for the collection of balls in a game and a central scoring indicator carrying numbers indicating scoring values for particular collection holes.

6. A game apparatus according to claim 5 wherein the scoring indicator includes a stake pocket for counters.

7. A game appraratus according to claim 1 further including a stabilising plate and a number of anti-rotational rays for use when a game is played in water.

8. A game apparatus suitable for playing with balls comprising a circular first base member having two opposed holes therein, an inverted U-shaped support extending over the first base member and releasably secured within the two opposed holes, a target suspended from the support for preventing balls passing through a part of the area defined by the inverted U-shaped support, a number of pegs mounted on the circumference of the first base member, a secondary base member forming a collection surface on the first base member and having a collection hole formed therein in radial alignment with each peg for the collection of balls in a game and a central scoring indicator formed in the middle of the collection surface so that a player may determine a point score.

9. A game apparatus according to claim 8 wherein the scoring indicator is rotatable.

10. A game apparatus suitable for playing with balls comprising a first base member having a plurality of holes about the periphery thereof, a secondary base member disposed over the first base member and having a number of collection holes formed therein for the collection of balls in a game, a scoring indicator formed in the middle of the collection surface so that a player may determine a point score and a raised peripheral boundary supported away from the surface of the secondary base member by a number of upstanding pegs secured to the first base member through said plurality of peripheral holes.

* * * * *